US007877819B2

(12) United States Patent
von Blücher et al.

(10) Patent No.: US 7,877,819 B2
(45) Date of Patent: Feb. 1, 2011

(54) NBC-PROTECTIVE CLOTHING WITH AN IMPROVED AIR-EXCHANGE FUNCTION

(75) Inventors: Hasso von Blücher, Erkrath (DE); Bertram Böhringer, Wuppertal (DE)

(73) Assignee: Blucher GmbH, Erkrath (DE)

( * ) Notice: Subject to any disclaimer, the term of this patent is extended or adjusted under 35 U.S.C. 154(b) by 432 days.

(21) Appl. No.: 11/805,221

(22) Filed: May 22, 2007

(65) Prior Publication Data

US 2007/0275619 A1 Nov. 29, 2007

(30) Foreign Application Priority Data

May 23, 2006 (DE) ..... 10 2006 024 526
Jul. 12, 2006 (DE) ..... 10 2006 032 145

(51) Int. Cl.
*A41D 13/00* (2006.01)

(52) U.S. Cl. ..... 2/69

(58) Field of Classification Search ..... 2/69, 2/243.1, 79, 227, 228, 901
See application file for complete search history.

(56) References Cited

U.S. PATENT DOCUMENTS

| | | | | |
|---|---|---|---|---|
| 2,994,089 | A | 8/1961 | Ferguson, Jr. et al. | 2/81 |
| 3,586,596 | A | 6/1971 | Ainsworth et al. | 161/87 |
| 3,818,507 | A | 6/1974 | Albrecht | 2/2 |
| 4,510,193 | A | 4/1985 | Blücher et al. | 428/196 |
| 5,383,236 | A * | 1/1995 | Sesselmann | 2/243.1 |
| 5,743,775 | A | 4/1998 | Baurmeister | 442/77 |
| 6,009,559 | A * | 1/2000 | Sesselmann | 2/243.1 |
| 6,134,718 | A * | 10/2000 | Sesselmann | 2/243.1 |
| 6,227,383 | B1 | 5/2001 | De Ruiter et al. | 210/504 |
| 2004/0006815 | A1 | 1/2004 | Carroll et al. | 2/457 |
| 2007/0059504 | A1 | 3/2007 | Von Blücher | 428/220 |

FOREIGN PATENT DOCUMENTS

| | | | |
|---|---|---|---|
| DE | 33 04 349 | A1 | 2/1983 |
| DE | 195 05 174 | B4 | 2/1995 |
| DE | 197 91 658 | A1 | 1/1997 |
| DE | 197 32 205 | A1 | 2/1999 |
| EP | 0 190 838 | A2 | 8/1986 |
| EP | 0 827 451 | B1 | 5/1996 |
| GB | 1 392 136 | | 4/1975 |
| WO | WO 96/37365 | A1 | 5/1996 |
| WO | WO 2004/073798 | A1 | 9/2004 |
| WO | WO 2005/049147 | A1 | 6/2005 |

* cited by examiner

*Primary Examiner*—Tejash Patel
(74) *Attorney, Agent, or Firm*—Woodard, Emhardt, Moriarty, McNett & Henry LLP

(57) ABSTRACT

The invention relates to protective clothing with a protective function against chemical and/or biological contaminants, especially for civil or military purposes, such as NBC protective clothing, with the protective clothing having a multiple-layer construction or a multiple-ply textile construction with an outer material and an inner material equipped with a protective function against chemical and/or biological contaminants, with the protective clothing being provided with at least one ventilation opening that is closed with a gas-permeable, in particular, air-permeable protective filter material that sorbs chemical and/or biological contaminants. In this way, when the clothing is being worn, the air supply and the air exchange is increased in an efficient way and the removal of moisture, in particular, sweat, and also excess body heat, is improved and thus the overall comfort in wearing the clothing is increased, without negatively affecting the protective function of the clothing.

17 Claims, 3 Drawing Sheets

NBC-PROTECTIVE CLOTHING WITH AN IMPROVED AIR-EXCHANGE FUNCTION

CROSS REFERENCES TO RELATED APPLICATIONS

This application claims priority to German Patent Application No. DE 10 2006 024 526.1, filed May 23, 2006, and also claims priority to German Patent Application No. DE 10 2006 032 145.6, filed Jul. 12, 2006, entitled "NBC-PROTECTIVE CLOTHING WITH AN IMPROVED AIR-EXCHANGE FUNCTION". Both references are expressly incorporated by reference herein, in their entirety.

BACKGROUND OF THE INVENTION

The present invention relates to protective clothing, especially NBC-protective clothing, with an improved air-exchange function.

In particular, the present invention relates to protective clothing with a protective function against chemical and/or biological contaminants, especially for civil or military purposes, such as NBC-protective clothing or the like, according to the present invention.

In addition, the present invention relates to a method for improving the air exchange in protective clothing of the type named above with a protective function against chemical and/or biological contaminants.

There is a series of substances that are absorbed by the skin and lead to severe bodily injuries. As examples of, for example, chemical or biological contaminants, especially warfare agents, e.g., the vesicant yperite (mustard gas) and the nerve gas sarin, shall be mentioned. People who come in contact with such poisons must wear a suitable protective suit or must be protected against these poisons through suitable protective materials.

In principle there are three types of protective suits: protective suits that are impermeable to air and water vapor and that are equipped with an unvulcanized or vulcanized rubber layer that is impermeable to chemical poisons and lead very quickly to a buildup of heat, also protective suits that are permeable to air and water vapor and that offer the highest level of wearing comfort, and finally protective suits that are equipped with a membrane that allows the penetration, in general, of water vapor but not of the mentioned poisons.

NBC-protective clothing is thus traditionally manufactured either from completely impermeable systems (e.g., suits made from butyl rubber) or from selectively permeable systems (e.g., membrane systems) or else from permeable, especially absorbent filter systems, preferably on the basis of activated carbon (e.g., activated carbon powder, activated carbon fibers, activated carbon grains, activated carbon pellets, etc.).

Protective suits against chemical warfare agents, which are designed for long-term use under a wide array of conditions, are not allowed to lead to heat buildup for the wearer. Therefore, in the civil and military sector, especially for uses in disaster or war zones, mainly air-permeable materials or else, at most, selectively permeable membrane systems are used.

Air-permeable protective suits in general possess an adsorbent layer with activated carbon, which very strongly bonds the chemical poisons so that there is absolutely no danger for the wearer even for strongly contaminated suits. The great advantage of this system lies in that the activated carbon is also accessible on the inside of the protective suit, so that any poisons penetrating through damaged or otherwise non-tight locations can be absorbed very quickly. The adsorbent layer in the previously described air-permeable protective suits is constructed, for example, such that activated carbon particles, e.g., on average up to circa 1.0 mm, are fixed to adhesive clumps or positions deposited on a carrier, wherein the adsorbent layer is generally supplemented by an "external material" (i.e., a cover material) and is covered on the inside facing the carrier by a lightweight textile material in the form of an inner lining. However, occasionally one also finds composite materials that include an activated carbon fibrous textile, e.g., an activated carbon fibrous non-woven.

In addition, protective suits are used that are equipped with a membrane that is constructed as water-vapor-permeable for increasing the wearing comfort, but that simultaneously acts as a barrier against liquids and gases, especially poisonous substances. Such a material is described, for example, in EP 0 827 451 A2. Protective suits with a membrane that is permeable to water vapor but impermeable to poisons, especially vesicants, however, have the disadvantage that poisons penetrating at non-tight locations remain in the interior of the protective suit and are absorbed by the skin of the wearer. Therefore, protective suits have been designed that combine the membrane and absorbent layer with each other (cf. WO 2005/049147 A1).

Due to the intended protective function of the type named above, air exchange is difficult even in permeable systems, especially due to the generally thick and tight top material, while it is not even present in impermeable or selectively permeable systems, especially on the membrane basis. Dependent on the structure and also influenced selectively by the construction of the textiles, in general the exchange of moisture with the surroundings takes place from a textile through openings, such as, e.g., for the neck, arms, legs, etc., (one example is underarm slits in raincoats, which should lead to improved removal of sweat, etc.), while in protective suits of the type named above with a protective function against biological and chemical poisons, the exchange of air with the surroundings largely must be prevented, especially also by means of a sealing connection at the previously mentioned openings for the neck, arms, legs, etc. Thus, for example, in protective suits very tight seals are intentionally used at the head, arms, legs, etc.

Consequently, even for permeable systems, a not-always-optimum air exchange is given, while such an air exchange is not provided at all in impermeable systems, e.g., with unvulcanized or vulcanized rubber or in selectively permeable systems on a membrane basis, so that not only is the wearing comfort reduced, but also an increased bodily strain, particularly physical exertion, is generated for the wearer of such a protective suit (e.g., in an operational area or war zone), because adequate air and moisture exchange, and consequently adequate heat dissipation, are not possible.

One aspect addressed by the present invention relates to providing protective clothing of the type named above, especially with a protective function against chemical and/or biological contaminants, preferably for civil or military purposes, such as NBC-protective clothing or the like, in which the previously mentioned disadvantages of the state of the art are largely prevented or else at least lessened. In particular, such protective clothing should exhibit an improved air-exchange function and also an improved moisture exchange function (e.g., for removing sweat, etc.).

The previously mentioned problem is solved within the scope of the present invention by protective clothing according to the disclosure and claims. Additional advantageous constructions of the protective clothing according to the invention are also the subject matter of the disclosure and claims.

An additional aspect of the present invention is a method for improving the air exchange in protective clothing of the type named above according to the disclosure and claims.

The applicant has now discovered surprisingly that the problem mentioned above can be solved efficiently in that the protective clothing in question is provided with at least one ventilation opening, which itself is closed with a gas-permeable, especially air-permeable, protective filter material that sorbs chemical and/or biological contaminants.

The subject matter of the present invention—according to a first aspect of the present invention—is thus protective clothing with an improved air-exchange function and also with a protective function against chemical and/or biological contaminants, especially for civil or military purposes, such as NBC protective clothing or the like, wherein the protective clothing has a multiple-layer design (i.e., a multiple-ply textile construction), which comprises an outer material and an inner material equipped with a protective function against chemical and/or biological [contaminants], wherein the protective clothing has at least one ventilation opening, which is closed with a gas-permeable, especially air-permeable, protective material that sorbs chemical and/or biological contaminants.

The terms "outer material" on one hand and "inner material" on the other hand relate to the wearing state of the protective clothing, i.e., in the wearing state of the protective clothing, the outer material faces away from the wearer of the protective clothing and consequently faces the outer surroundings or is in contact with these surroundings, while the inner material, in the wearing state, faces the wearer or faces away from the outer surroundings (i.e., is arranged on the body side). Thus, for example, the outer material, as described below, can be a top material, while the inner material performs the actual protective function against chemical and/or biological poisons, as described below in detail.

Through the construction of the protective clothing according to the invention, the air exchange in the wearing state is improved efficiently according to the present invention. Simultaneously, the exchange or removal of moisture, especially sweat, is improved. Therefore, the measure according to the invention leads to a clear improvement in the wearing comfort and, under real use conditions, equally to reduced bodily strain on the wearer of such protective clothing, especially during physical activity.

As described below, the concept according to the invention can be applied universally, i.e., both for permeable systems of the type named above and also for impermeable or selectively permeable systems, especially membrane systems, of the type named above. While it is sufficient to provide the outer material with one or more such ventilation openings in air-permeable systems, in the case of impermeable systems with a membrane arranged on the inside, at least the inner material or the membrane must be provided with such a ventilation opening in order to guarantee improved air exchange as well as equally improved moisture removal. This will be discussed in detail below.

In the scope of the present invention, the term of chemical and biological contaminants is understood to be very far-reaching and includes any kind of chemical toxicant (e.g., chemical warfare agents, etc.) and biological poisons (e.g., biological warfare agents such as microorganisms, viruses fixed to carrier particles, etc.).

As previously mentioned, the ventilation opening(s) intentionally formed for improving the air-exchange function in the protective clothing according to the invention is or are closed with a protective filter material, which has a gas-permeable, especially air-permeable, construction and which sorbs chemical and/or biological contaminants efficiently, in particular through adsorption and/or absorption, preferably through adsorption.

In the scope of the present invention, the term sorption relates to a collective term for all processes in which a chemical or biological material is received by another material in contact with the chemical or biological material, in the present case the chemical and/or biological contaminants by the sorbent protective filter material. Examples for sorption processes are adsorption, absorption, chemisorption, and physisorption, persorption, resorption etc. The sorbed substance is designed as the sorbate and the sorbing substance is designated as the sorbent, sorption means, sorption material, etc. Preferably, according to the invention the sorption is performed by means of adsorption and/or absorption, preferably by means of adsorption. For additional details on the term of sorption as well as adsorption, absorption etc., refer to, for example, Römpp Chemielexikon, 10th edition, Georg Thieme Verlag, Stuttgart/New York, there the related head words: "Sorption," "Adsorption," "Absorption," etc., and the references cited there.

As described above, a special feature of the present invention is to be seen in that the protective clothing is provided with at least one ventilation opening for improving the air exchange as well as the moisture and heat removal, with this opening being closed, in turn, with the gas-permeable, especially air-permeable, protective filter material in question that sorbs chemical and/or biological contaminants. The closing of the ventilation opening is performed here generally such that at least the ventilation opening itself is closed or filled with the protective filter material in question. In general, however, it is provided that the previously named sorbent protective material not only closes the ventilation opening as such, but also extends past the edges of the ventilation opening: if, for example, in permeable protective clothing, the ventilation opening is formed in the outer material, then the outer material is coated or, so-to-speak, lined on the inside with the sorbent protective filter material (e.g., through inner attachment of the protective film material on the outer material in the area of the ventilation opening and outwards), so that on one hand the ventilation opening itself is closed, and on the other hand the edge regions of the ventilation opening are coated or cladded with the protective filter material. In this way, chemical and/or biological contaminants at the edges of the ventilation opening are prevented from being able to undesirably diffuse or flow past the sorbent protective filter material and thus reach the wearer of the protective clothing.

Additional advantageous properties, aspects, and features of the present invention emerge from the following description of an embodiment shown in the figures.

BRIEF SUMMARY

Disclosed is protective clothing with a protective function against chemical and/or biological contaminants, especially for civil or military purposes, such as NBC protective clothing, with the protective clothing having a multiple-layer construction or a multiple-ply textile construction with an outer material and an inner material equipped with a protective function against chemical and/or biological contaminants, with the protective clothing being provided with at least one ventilation opening that is closed with a gas-permeable, in particular, air-permeable protective filter material that sorbs chemical and/or biological contaminants. In this way, when the clothing is being worn, the air supply and the air exchange is increased in an efficient way and the removal of moisture, in particular, sweat, and also excess body heat, is improved and thus the overall comfort in wearing the clothing is increased, without negatively affecting the protective function of the clothing.

One object of the present invention is to disclose improved protective clothing.

DETAILED DESCRIPTION

Figure 1:
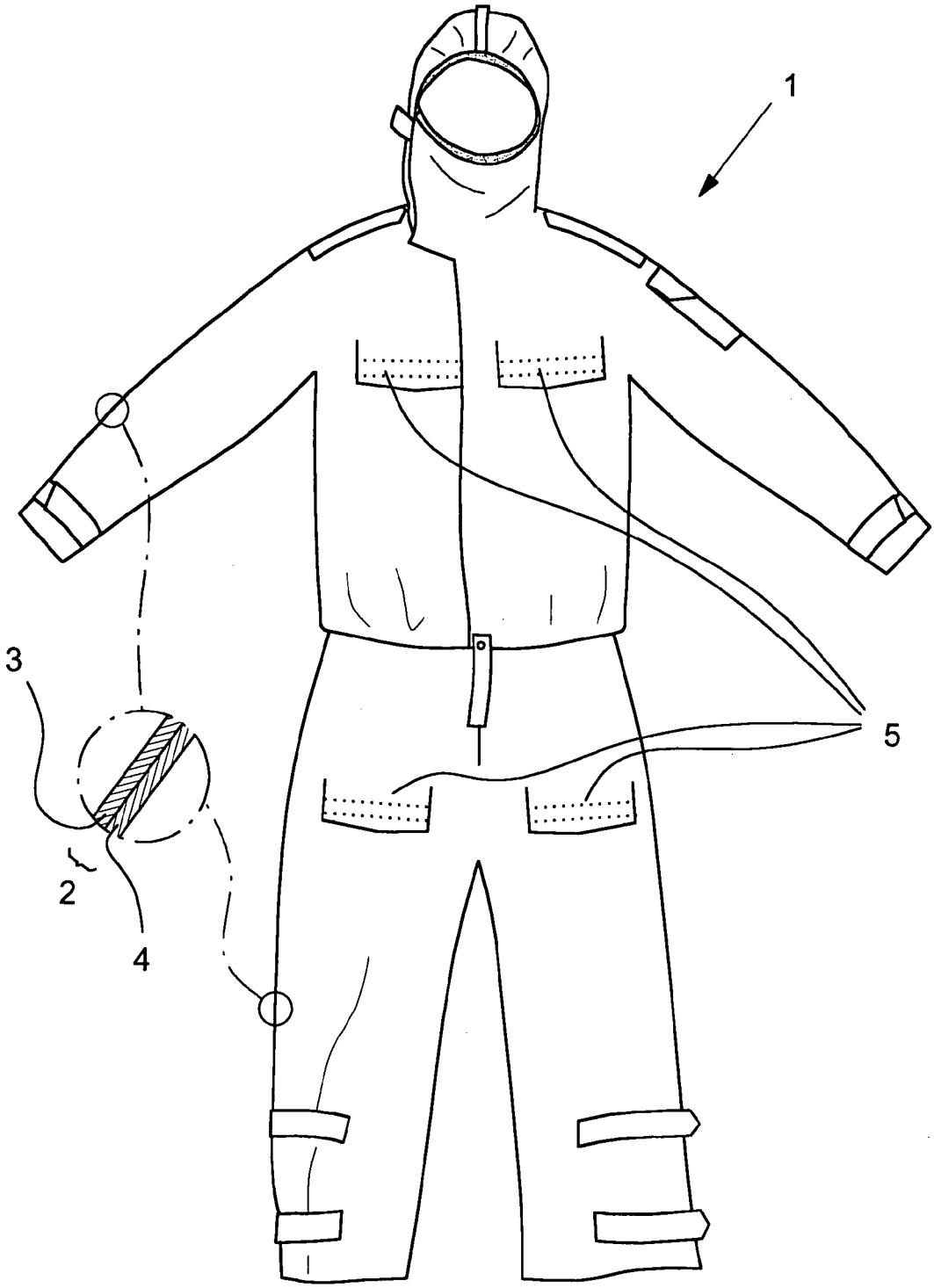
FIG. 1 is a diagrammatic, front elevational view of protective clothing according to the invention in the form of a two-part protective suit, which is provided with ventilation openings in the chest region of the top part, in particular a jacket, and in the thigh region of the bottom part, in particular pants, wherein the enlarged cut-out shown in the circle represents a schematic section view through the multiple-layer design or the multiple-ply construction of the article of clothing according to the invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2:
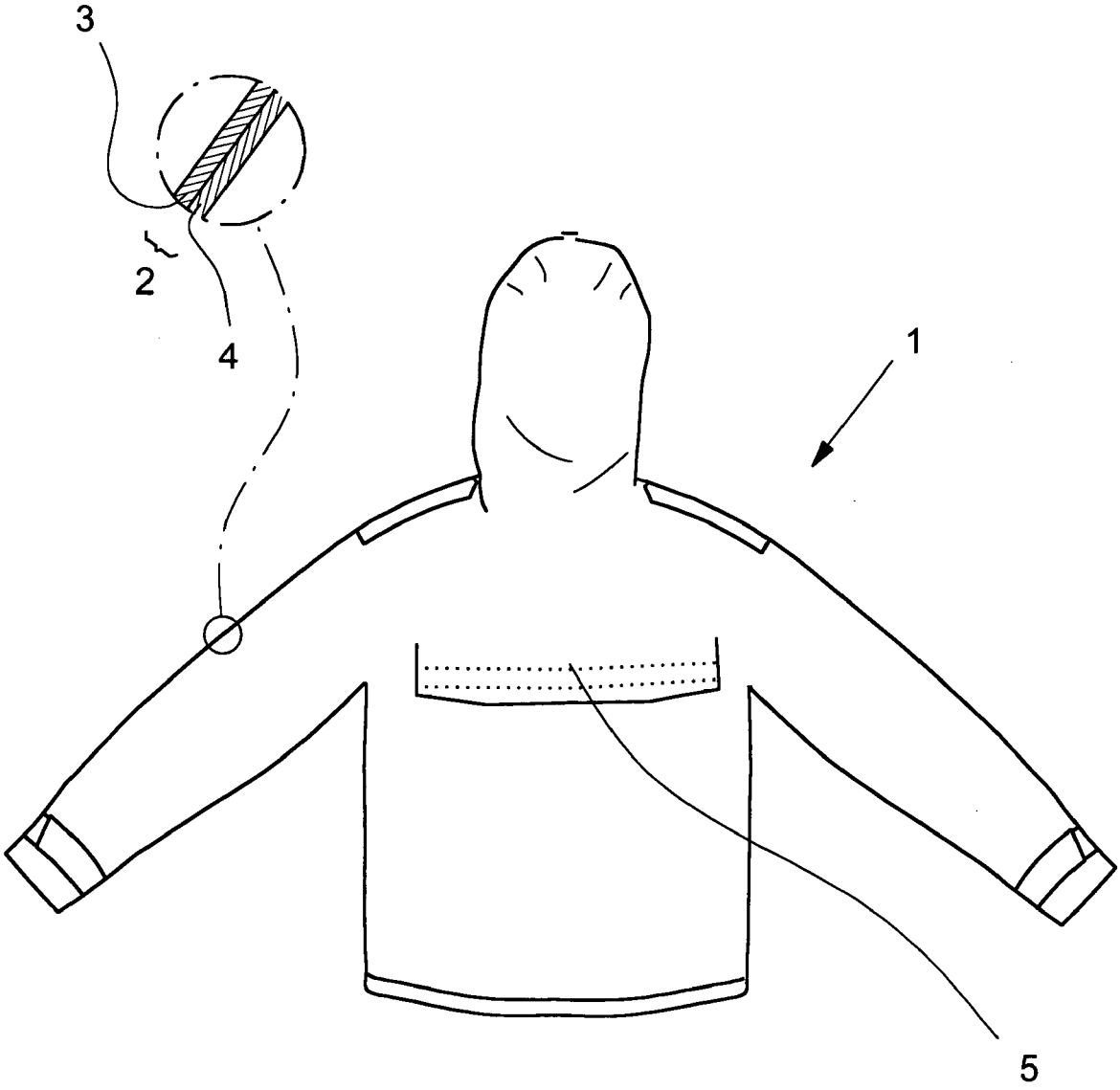
FIG. 2 is a diagrammatic, front elevational view of protective clothing according to the invention in the form of a top part, in particular a jacket, which is provided with a ventilation opening provided according to the invention in the area of the back, wherein the enlarged cut-out shown in the circle represents a schematic section view through the multiple-layer design or the multiple-ply construction of the article of clothing according to the invention.

FIGS. 1 and 2 show diagrammatically protective clothing 1 according to the invention with an improved air-exchange function and moisture-exchange function, wherein the protective clothing 1 is equipped or retrofitted with a protective function against chemical and/or biological contaminants. This clothing involves, in particular, protective clothing for civil or military purposes, such as NBC protective clothing or the like. The protective clothing 1 has a multiple-layer design 2, wherein the multiple-layer design 2 comprises an outer material 3 and an inner material 4 equipped with a protective function against chemical and/or biological contaminants. As described below, the inner material 4 equipped with a protective function against chemical and/or biological contaminants involves either a permeable (i.e., air-permeable) system, especially on the basis of an adsorption filter material (e.g., activated carbon, especially in particle form, and fixes to an air-permeable textile carrier), or else, alternatively, to an air-impermeable system, i.e., either an impermeable (i.e., impermeable to air, water, and water vapor) system, especially on an unvulcanized or vulcanized rubber basis, or a selectively permeable (i.e., impermeable to air and water but permeable to water vapor) system, especially on a membrane basis.

As can be seen from the figures (FIGS. 1 to 3), the protective clothing 1 has at least one ventilation opening 5, wherein the ventilation opening 5 is closed with a gas-permeable, especially air-permeable, protective filter material 6 sorbing chemical and/or biological contaminants. In this respect, refer to the preceding constructions.

With respect to the outer material 3, this is generally gas-permeable, especially air-permeable. In general, the outer material 3 involves a flat textile material, especially a woven fabric, a knitted fabric, a stitched fabric, a laminated fabric, a textile composite, a fleece or a non-woven. Preferably, the outer material 3 is a flat flexible textile formed body, especially in the form of a top material. For improving the protective function, especially for preventing the penetration of large droplets of chemical or biological contaminants, it can also be provided to impregnate the outer material 3, in particular to subject the outer material 3 to oil-repellant and/or water-repellant finishing.

To guarantee a significantly improved air-exchange function in the protective clothing 1 according to the invention, it is preferred according to the invention if the gas permeability, especially the air permeability, of the protective filter material 6 corresponds to at least 1.5 times, in particular at least 2 times, preferably at least 3 times, especially preferred at least 5 times the gas permeability, especially the air permeability of the outer material 3.

For guaranteeing a good air-exchange function, it is advantageous if the protective filter material 6 has, for example, for a flow resistance of 127 Pascal, an air permeability of at least 10 $l \cdot m^{-2} \cdot s^{-1}$, especially at least 30 $l \cdot m^{-2} \cdot s^{-1}$, preferably at least 50 $l \cdot m^{-2} \cdot s^{-1}$, especially preferred at least 100 $l \cdot m^{-2} \cdot s^{-1}$, extremely especially preferred at least 400 $l \cdot m^{-2} \cdot s^{-1}$.

Figure 3:
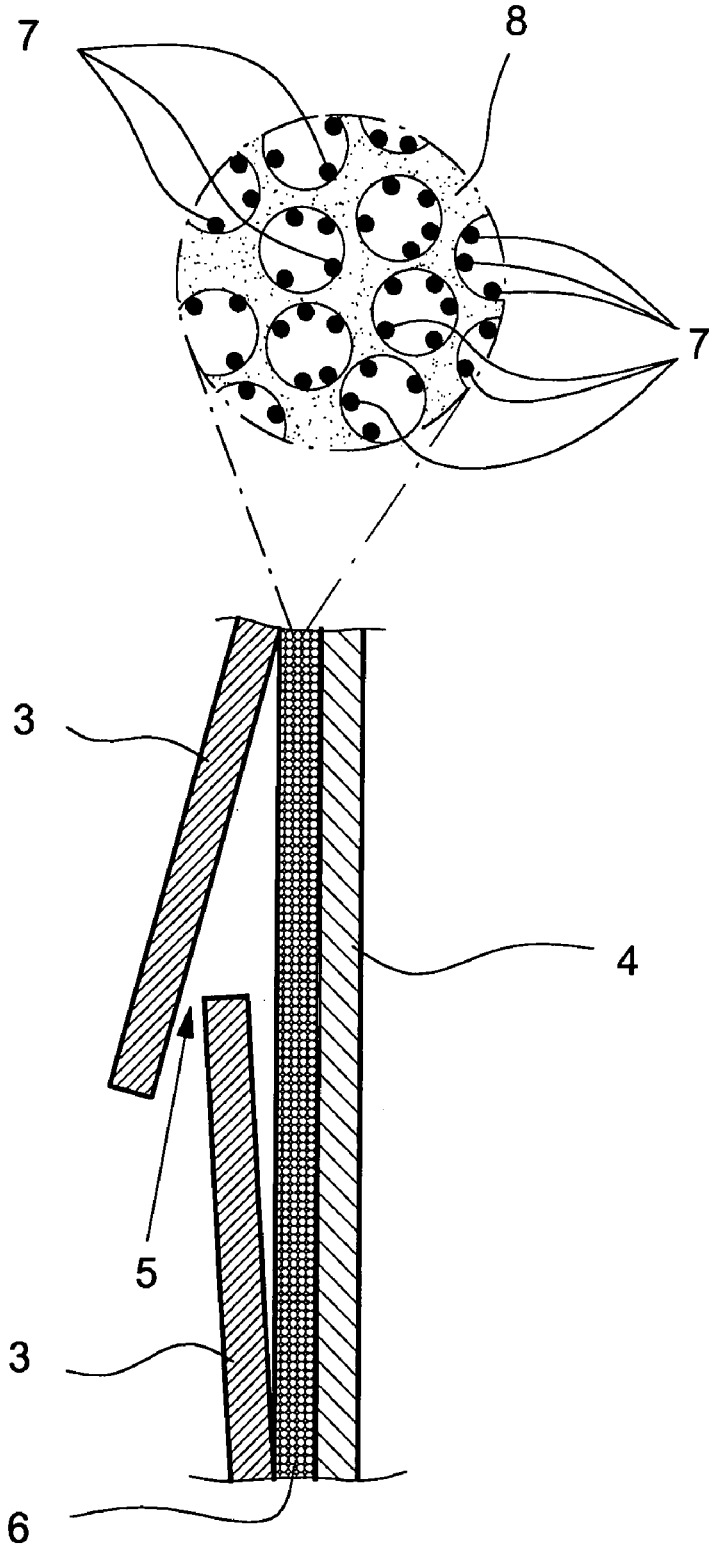
FIG. 3 is a diagrammatic section view through protective clothing according to the invention in the area of the ventilation opening, wherein the enlarged cut-out shown in the circle represents a schematic section view through the protective material closing the ventilation opening.

With respect to the gas-permeable, especially air-permeable protective filter material 6 sorbing the chemical and/or biological contaminants, this generally features a sorption material 7 sorbing, in particular adsorbing and/or absorbing, preferably adsorbing, chemical and/or biological contaminants (cf. FIG. 3). In particular, the sorption material 7 can be selected from the group of activated carbon; zeolites; inorganic oxides, especially silicon dioxides, silica gels, and aluminum oxides; molecular sieves; mineral granulates; clathrates; as well as their mixtures. According to the invention, activated carbon is especially preferred. Preferably, the sorption material 7 is particulate, especially granular, preferably at least essentially spherical or else fibrous. In the case of a fibrous structure of the sorption material 7, it is preferred that the sorption material fibers (e.g., activated carbon fibers) form a flat formed body.

According to an especially preferred embodiment, the protective filter material 6 has activated carbon as the chemical and/or biological contaminant sorbent, in particular adsorbent or absorbent, preferably adsorbent, sorption material 7, preferably in the form of activated carbon grains, advantageously activated carbon pellets. The preferred average particle diameter of the activated carbon grains, preferably activated carbon pellets, lies in the range from 0.01 to 2.0 mm, especially 0.05 to 1.0 mm, preferably 0.1 to 1.0 mm.

According to the invention, it is preferred if the activated carbon used as the preferred sorption material 7 (independent of whether the activated carbon is used as particles, e.g., activated carbon grains or activated carbon pellets, or else as fibers, e.g., flat activated carbon fiber formed bodies) features a specific surface (BET surface) of at least 500 $g/m^2$, especially at least 750 $g/m^2$, preferably at least 1000 $g/m^2$, especially preferred at least 1200 $g/m^2$, preferably in the range from 500 to 2500 g/m$^2$, especially 750 to 2250 g/m$^2$, preferably 900 to 2000 g/m$^2$, especially preferred 1000 to 1750 g/m$^2$.

When activated carbon is used as the sorption material 7 in the form of activated carbon grains, especially activated carbon pellets, these advantageously feature a bursting pressure of at least 5 Newton, especially at least 10 Newton, preferably in the range from 5 Newton to 20 Newton, per particle, so that a high mechanical load capacity, especially a high abrasion resistance is given for the activated carbon grains or pellets.

The activated carbon used as the preferred sorption material 7 according to the invention advantageously has—independent of whether it is used in grain or pellet form or else in fiber form—a total adsorption volume $V_{ads}$ of at least 200 cm$^3$/g, especially at least 300 cm$^3$/g, preferably at least 350 cm$^3$/g, especially preferred at least 400 cm$^3$/g, which lies especially in the range from 250 to 1000 cm$^3$/g, preferably 300 to 900 cm$^3$/g, advantageously 350 to 750 cm$^3$/g. Especially preferred is an activated carbon with a high specific micropore surface percentage, especially with a high specific micropore surface percentage formed from pores with diameters of ≦25 Å, preferably of at least 70%, especially at least 75%, advantageously at least 80%, relative to the specific total surface (BET) of the activated carbon.

According to a preferred construction according to the invention—as also shown in FIG. 3 (cf. enlarged cut-out)—the sorption material 7 sorbing, in particular adsorbing and/or absorbing, preferably adsorbing, the chemical and/or biological contaminants is fixed on a carrier 8, especially on a flat carrier material or else preferably on a three-dimensional carrier structure. This can be performed, for example, by means of bonding. For this purpose, either a bonding agent or else some inherent adhesiveness of the carrier 8 (for example, heat adhesiveness of, e.g., PU foam) is used. In the case of fixing, care should be taken that the sorption material 7 is not completely covered by the bonding agent, so that it is freely accessible for the contaminants to be sorbed. Advantageously, for the fixing of at least 60%, preferably at least 70%, especially preferred at least 80%, extremely especially preferred at least 90% of the available surface area of the sorption material 7 is freely accessible to the contaminants to be sorbed or is not covered by bonding agent.

According to an especially preferred embodiment, the protective filter material 6 comprises a carrier 8, especially a three-dimensional carrier structure, in the form of a foam structure, especially foaming agent structure, to which the sorption material 7 is attached or fixed. This embodiment is shown in the enlarged cutout from FIG. 3. The carrier 8, especially the three-dimensional carrier structure, can here be formed as preferably an open-pore and/or open-cell foam, especially foaming agent. A suitable carrier 8, especially a suitable three-dimensional carrier structure, is, for example, a preferably open pore and/or open-cell foaming agent on the basis of at least one organic polymer, especially on the basis of polyurethanes, polyolefins, polystyrenes, polyvinyl chlorides, polyisocyanurates, and formaldehyde resins, especially preferred a polyurethane foaming agent. Especially preferred according to the invention, an open-pore and/or open-cell foaming agent made on a polyurethane basis ("PU foam") is used, to which the particulate sorption material 7 is fixed.

According to an especially preferred embodiment, as the protective filter material 6 a material is used, which has an open-pore and/or open-cell foaming agent, especially polyurethane foaming agent, as the carrier 8, on which the sorption material 7 is fixed in the form of activated carbon particles, especially activated carbon grains, preferably activated carbon pellets, preferably by means of bonding. Here, the activated carbon with the previously mentioned properties is used in particular. The loading quantity of the foam or foaming agent with activated carbon particles lies here advantageously in the range from 0.001 to 10 g/cm$^3$, especially 0.01 to 5 g/cm$^3$, preferably 0.1 to 1 g/cm$^3$. Such a foaming agent loaded with activated carbon particles and its production are known, for example, from the German Auslegeschrift DE 28 04 154 B1, whose contents are hereby incorporated through reference.

A material on the basis of a foaming agent loaded with activated carbon suitable as the protective filter material 6 provided according to the invention can be produced, for example, whereby initially the foaming agent is impregnated with a preferably heat-curable bonding agent, then excess bonding agent is squeezed off, and then the carrier structure is sprayed with activated carbon grains, which then settle into the open pores or open cells of the foaming agent and are fixed there by bonding agent, followed by a subsequent heat treatment for curing the bonding agent. This is known as such to someone skilled in the art from the state of the art.

The three-dimensional carrier structure 8, especially the foam or foaming agent, has a flexible and/or compressible construction in this embodiment of the protective filter material 6. Preferably, an elastic, especially elastically deformable foam or foaming agent, preferably PU foam, is used as the three-dimensional carrier structure 8. In this way, a certain flexibility is achieved in the wearing state or under a wearing load.

For further details on the terms foam and foaming agent, refer, for example, to Römpp Chemielexikon, 10th edition, Georg Thieme Verlag, Stuttgart/New York, head words: "foaming agents," "flexible foaming agents," "integral foaming agents," and "foam", as well as to the references cited there.

According to an alternative embodiment, for the protective filter material 6—instead of a three-dimensional carrier structure—a flat carrier material can be used, in particular a flat textile material (e.g., a woven fabric, a knitted fabric, a stitched fabric, a laminated fabric, a textile composite, fleece or a non-woven), on which activated carbon particles of the type named above are then fixed—preferably by means of bonding. However, this alternative embodiment is less preferred according to the invention. In this embodiment, the adsorption capacity and thus the protective function of the protective filter material 6 can be increased in that the flat, preferably strip-shaped carrier material loaded with the sorption material 7 (e.g., activated carbon) is folded, especially folded multiple times (i.e., folded into two or more carrier material layers lying or arranged one above the other), preferably in the form of a zigzag fold; due to the folding, several layers connected, so-to-speak, by means of the folding in the flat carrier material loaded with the sorption material 7 are set one above the other, wherein all of these layers have to be passed through before the air reaches the interior of the protective clothing 1. Such folded filter structures are known as such to someone skilled in the art from the state of the art (cf., e.g., DE 197 01 658 A1 or DE 195 05 174 B4). Alternatively, in the same way, several unconnected layers of the flat carrier material loaded with the sorption material 7 can be laid one on top of the other, but this is less preferred according to the invention.

For improving the protective function relative to contaminant particles or contaminant aerosols, the protective filter material 6 can also be equipped, preferably in the wearing state, on the outside with a particle and/or aerosol filter layer, preferably a particle and aerosol filter layer, advantageously in the form of a flat textile formed body (not shown in the figures). Particle and/or aerosol filter layers are in principle known to someone skilled in the art, so that this does not need to be discussed in more detail. According to the invention, it is preferred if the optionally used particle and/or aerosol filter layer has an average efficiency $E_m$ according to DIN EN 779 (July 1993) of at least 40%, especially at least 50%, preferably at least 70%, especially preferred at least 90%, extremely especially preferred at least 95% or more. In particular, the optional particle and/or aerosol filter layer should exhibit, for an inflow of 0.1 m/s, an average separating rate in terms of particles and/or aerosols with diameters in the range from 0.1 to 0.3 μm of at least 80%, especially at least 90%, preferably at least 95%. It is preferred if the optional particle and/or aerosol filter layer, for an inflow of 0.1 m/s, exhibits an average separating rate in terms of particles and/or aerosols with diameters≧2 μm, especially ≧1.5 μm, of at least 95%, especially at least 98%, preferably at least 99%.

Furthermore, the protective filter material 6 can be provided, especially on the inside and/or outside, with a preferably lattice-shaped, air-permeable cover (also not shown in the figures). The preferably lattice-shaped, air-permeable cover can be used, on one hand, for reinforcing the protective filter material 6. On the other hand, it can protect the protective filter material 6 from coarse contaminants and thus from undesired blockage.

According to the invention it is preferred if the ventilation opening 5 is formed like a slit, especially in the form of a slit running horizontally in the wearing state. According to the number of ventilation openings 5, the width of the slit can vary broadly: in general, such ventilation slits 5 have a slit width from 1 to 30 cm, preferably 2 to 20 cm, especially 3 to 10 cm.

The profile of the ventilation opening 5, especially for a slit-like construction, can be, in principle, horizontal or vertical when the protective clothing 1 is being worn; preferably, however, there is a horizontal profile of the ventilation opening 5 in the wearing state, so that there is reduced mechanical loading, especially a reduced tearing load.

To increase the durability of the protective clothing 1 according to the invention, the ventilation opening 5 can be reinforced against mechanical loading, especially against a tearing load. This can be realized, for example, through stabilization or reinforcement of the edge of the ventilation opening 5 (e.g., through hemming, applying an additional, especially reinforcing, material to the edge of the opening, etc.). In the case of slit-like ventilation openings 5, for example, at least in the corners of the slit there is reinforcement because the greatest mechanical loading, especially the greatest tear load, occurs there in the wearing state.

In general the ventilation opening 5 is constructed so that the main air inlet direction or the main air inflow direction is at least essentially parallel to the outer material 3 and/or at least essentially vertical with respect to the ventilation opening 5 when the protective clothing 1 is being worn.

According to a preferred embodiment according to the invention, the protective clothing 1 is provided with a plurality of ventilation openings 5, especially with at least two ventilation openings 5.

When the protective clothing 1 involves a top part, especially a jacket, or else also a one-piece suit, especially in the form of coveralls, the ventilation openings 5 are arranged in the wearing state in the chest and/or back region, preferably at least in the chest region (cf. FIGS. 1 and 2). When the protective clothing 1 according to the invention involves a bottom part, especially pants, or a whole suit, especially in the form of coveralls, one or more ventilation openings 5 can also be arranged in the thigh region in the wearing state.

As previously mentioned, the concept according to the invention can be applied to both permeable and also impermeable or selectively permeable (i.e., air-permeable as well as air-impermeable) articles of protective clothing:

In the case of permeable, i.e., air-permeable protective clothing 1, the inner material 4 has an air-permeable construction and comprises, in particular, a gas-permeable, especially air-permeable adsorption filter material adsorbing chemical and/or biological contaminants, wherein the adsorption filter material comprises an adsorption agent, especially activated carbon, adsorbing chemical and/or biological contaminants, preferably fixed to an especially flat textile material. Here, the activated carbon can be provided in the form of activated carbon fibers, especially in the form of an activated carbon flat fibrous formed body or else especially preferred in the form of activated carbon grains, preferably activated carbon pellets. Here, preferably the same activated carbon is used for the protective filter material 6, so that with respect to this material, the preceding statements can be referenced. Such permeable or air-permeable protective clothing is known from the state of the art (cf. e.g., DE 33 04 349 A1 and the state of the art mentioned above).

For the permeable or air-permeable protective clothing 1 of the type named above, it is sufficient to provide the outer material 3 with one or more ventilation openings 5. This embodiment is shown in FIG. 3. Here, the ventilation openings 5 can be formed or arranged in particular in an overlapping region of the outer material 3, as shown in FIG. 3. In general, the preferably slit-like ventilation openings 5 are covered in the wearing state on the outside by an overlapping material piece of the outer material 3, i.e., the overlap is such that an air slit remains between the overlapping material pieces of the outer material 3. This slit then allows air passage. In this embodiment, the protective filter material 6 is preferably connected or fixed to the outer material 3, especially on its inside (e.g., through bonding, sewing, stitching, etc.), as shown in FIG. 3.

When air-impermeable protective clothing 1 of the type named above is used (i.e., either an impermeable, that is, an air, water, and water vapor impermeable system, especially on an unvulcanized or vulcanized rubber basis, or else a selectively permeable, that is an air and water impermeable but water vapor-permeable [system]), in particular an air-impermeable selectively permeable system especially on a membrane basis, the inner material 4 has a layer that is at least essentially impermeable relative to chemical and/or biological contaminants and at least essentially impermeable to water and air and that has an advantageously water-vapor-permeable construction in the case of membrane systems and is also impermeable to water vapor in the case of a completely impermeable system, e.g., on an unvulcanized or vulcanized rubber basis. Such protective clothing constructions as such are also known to someone skilled in the art from the state of the art. In this embodiment, at least the inner material 4 is provided with one or more ventilation openings 5 (not shown in the figures). Here, the ventilation openings 5 are advantageously formed or arranged in an overlapping region of the inner material 4, i.e., the ventilation openings 5 are covered in this embodiment in the wearing state on the outside by an overlapping material piece of the inner material 4, wherein the overlap is such that an air slit remains between the overlapping material pieces. This slit allows air passage. In this embodiment, the protective filter material 6 is preferably connected to the inner material 4, especially on its inside (e.g., through bonding, sewing, stitching, etc.). In this embodiment, the outer material 3 can also be provided with one or more ventilation openings 5, especially in overlapping regions of the outer material 3 (i.e., the ventilation openings 5 are then covered on the outside by an overlapping material piece of the outer material 3, as previously mentioned for the permeable systems).

As a result, the concept according to the invention leads to a significantly increased level of wearing comfort due to the increased air exchange and due to the increased heat dissipation as well as also the improved moisture exchange or removal—and this without reducing the protective performance—wherein the concept according to the invention can be applied universally both to permeable (i.e., air-permeable) or selectively permeable (i.e., air-impermeable but water vapor-permeable), as well as impermeable (i.e., air and water vapor impermeable) systems.

In permeable protective clothing systems, an exchange of air and thus also a removal of sweat to the environment can be promoted without reducing the protective performance, in that, for example, in the chest area and/or in the area of the back, preferably horizontal or level ventilation openings preferably with overlapping textile are formed, e.g., in the form of slits, which are filled with an activated carbon-loaded foam for producing the protective effect, so that air exchange takes place exclusively through this foam, wherein, for increased protection from biological poisons, especially particles and aerosols, the activated carbon-loaded foam can also be covered on the inside and/or outside with a particulate filtration fleece. Purely permeable biological and/or chemical protective suits are conventionally composed of two layers, a top material and an activated carbon filter material connected to the top material at the seams as a lining; the described construction can be installed in both layers of the protective suit. However, because the filter material is generally very air-permeable, for wearing comfort reasons it is sufficient to form the slit-like ventilation openings exclusively in the top material and to line it with the activated carbon-loaded material.

For the case of impermeable systems (i.e., in the case of air-impermeable protective clothing), semi-permeable membranes (e.g., air and water impermeable but water vapor permeable membranes) or impermeable films are laminated onto the top material and optionally provided with another activated carbon layer as filter material. For the use of these impermeable materials, it is also possible to maintain the protective effect of a protective suit relative to biological and/or chemical contaminants when slit-like ventilation openings are formed in the membrane or film material, which overlap and are filled with an activated carbon loaded foaming agent such that air exchange can be performed only through the activated carbon loaded foaming agent material.

As a result, it is possible in the scope of the present invention to achieve an increased level of wearing comfort by increasing the air-exchange function as well as the moisture removal function, wherein the physical strain on the wearer, especially for strenuous physical activities, is also reduced in the wearing state.

Another subject matter of the present invention—according to a second aspect of the present invention—is a method for improving the air exchange in protective clothing 1 with a protective function against chemical and/or biological contaminants, especially for civil or military purposes or the like, wherein the protective clothing 1 has a multiple-layer design 2, which comprises an outer material 3 and an inner material 4 equipped with a protective function against chemical and/or biological contaminants. The method according to the invention is distinguished in that the protective clothing 1 is provided with at least one ventilation opening 5 for improving the air exchange and/or for improving the moisture removal, wherein the ventilation opening 5 is closed with a gas-permeable, especially air-permeable protective filter material sorbing chemical and/or biological contaminants. For more details on the method according to the invention—for avoiding unnecessary repetition refer to the statements above concerning the protective clothing according to the invention, which apply with respect to the method according to the present invention.

Additional constructions, embodiments, adaptations, modifications, and/or variations of the present invention are revealed to someone skilled in the art when reading the present description, without leaving the scope of the present invention.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. Protective clothing with a protective function relative to chemical and/or biological contaminants, wherein the protective clothing has a multiple-layer design, wherein the multiple-layer design comprises an outer material and an inner material equipped with a protective function against chemical and/or biological contaminants, wherein the outer material has a gas-permeable construction and is formed by a flat textile material, the outer material being subjected to an oil-repellant and/or water-repellant finishing, wherein the protective clothing has at least one ventilation opening in said outer material having a slit-like construction and being reinforced against mechanical loading, wherein the profile of the ventilation opening has a horizontal construction when the protective clothing is being worn and wherein the ventilation opening is closed with a gas-permeable protective filter material sorbing chemical and/or biological contaminants, the protective filter material having a sorption material sorbing, adsorbing or absorbing chemical and/or biological contaminants, wherein the sorption material is fixed to a carrier having a three-dimensional carrier structure, said carrier being positioned between said outer material and said inner material.

2. The protective clothing according to claim 1, wherein the outer material is a flexible flat textile formed body in the form of a top material.

3. The protective clothing according to claim 1, wherein the gas permeability of the protective filter material corresponds to at least 1.5 times the gas permeability of the outer material.

4. The protective clothing according to claim 1, wherein the sorption material is selected from the group of activated carbon, zeolites, inorganic oxides, silica gels, aluminum oxides, molecular sieves, mineral granulates, clathrates, and their mixtures and wherein the sorption material has a particulate or fibrous construction.

5. The protective clothing according to claim 1, wherein the sorption material is activated carbon in the form of activated carbon pellets, wherein the average particle diameter of the activated carbon pellets lies in the range from 0.01 to 2.0 mm.

6. The protective clothing according to claim 1, wherein the carrier is an open-pore or open-cell foaming agent.

7. The protective clothing according to claim 1, wherein the protective filter material comprises sorption material sorbing, adsorbing, or absorbing chemical and biological contaminants in the form of activated carbon particles, wherein the activated carbon particles are fixed to an open-pore or open-cell foaming agent as the carrier, wherein the loading quantity of the foaming agent with activated carbon equals 0.001 to 10 g/cm$^3$.

8. The protective clothing according to claim 1, wherein the protective filter material is equipped on the outside with a particle and aerosol filter layer.

9. The protective clothing according to claim 1, wherein the protective filter material is provided with an air-permeable cover.

10. The protective clothing according to claim 1, wherein the air inlet direction or air inflow direction is at least essentially parallel to the outer material or at least essentially vertical with respect to the ventilation opening in the wearing state.

11. The protective clothing according to claim 1, wherein the protective clothing has a plurality of ventilation openings.

12. The protective clothing according to claim 11, wherein the ventilation openings are arranged in the chest or back region in the wearing state.

13. The protective clothing according to claim 1, wherein the inner material is a gas-permeable adsorption filter material adsorbing chemical and biological contaminants.

14. The protective clothing according to claim 13, wherein the adsorption filter material comprises adsorption means on the basis of activated carbon adsorbing chemical and biological contaminants, wherein the activated carbon is fixed to a flat textile material.

15. The protective clothing according to claim 1, wherein the outer material is provided with one or more ventilation openings, wherein the ventilation opening(s) is or are formed or arranged in an overlapping region of the outer material and wherein the ventilation opening(s) is or are covered on the outside by an overlapping material piece of the outer material.

16. The protective clothing according to claim 1, wherein at least the inner material is provided with one or more ventilation openings, wherein the ventilation opening(s) is or are formed or arranged in an overlapping region of the inner material and wherein the ventilation opening(s) is or are covered on the outside by an overlapping material piece of the inner material.

17. The protective clothing according to claim 1, wherein the ventilation opening is reinforced relative to a tear load.

* * * * *